US007124816B2

(12) United States Patent
Årebråt

(10) Patent No.: US 7,124,816 B2
(45) Date of Patent: Oct. 24, 2006

(54) LIQUID SEPARATION DEVICE

(75) Inventor: Per Arild Årebråt, Stavanger (NO)

(73) Assignee: Perigon DA, Randaberg (NO)

( * ) Notice: Subject to any disclaimer, the term of this patent is extended or adjusted under 35 U.S.C. 154(b) by 254 days.

(21) Appl. No.: 10/473,188

(22) PCT Filed: Mar. 25, 2002

(86) PCT No.: PCT/NO02/00124
§ 371 (c)(1),
(2), (4) Date: Feb. 17, 2004

(87) PCT Pub. No.: WO02/077410

PCT Pub. Date: Oct. 3, 2002

(65) Prior Publication Data

US 2004/0112602 A1 Jun. 17, 2004

(30) Foreign Application Priority Data

Mar. 26, 2001 (NO) ..... 20011529
Jun. 11, 2001 (NO) ..... 20012867

(51) Int. Cl.
*E21B 33/13* (2006.01)
*E21B 33/136* (2006.01)
*E21B 33/14* (2006.01)

(52) U.S. Cl. ..... 166/192; 166/177.4; 166/136; 166/118

(58) Field of Classification Search ..... 166/177.4, 166/156, 285, 382, 136, 192, 118, 172, 213, 166/99
See application file for complete search history.

(56) References Cited

U.S. PATENT DOCUMENTS

| | | | | | |
|---|---|---|---|---|---|
| 1,896,482 | A * | 2/1933 | Crowell | 166/115 |
| 1,979,802 | A * | 11/1934 | Kinley | 166/192 |
| 2,652,118 | A | 9/1953 | Hartman et al. | |
| 3,114,422 | A | 12/1963 | Solum et al. | |
| 3,119,451 | A | 1/1964 | Hall | |
| 3,431,974 | A * | 3/1969 | Bruecher et al. | 166/136 |
| 3,572,433 | A * | 3/1971 | Conrad | 166/132 |
| 3,623,550 | A * | 11/1971 | de Lajarte et al. | 166/125 |
| 3,955,625 | A * | 5/1976 | Hughes et al. | 166/202 |
| 4,787,458 | A * | 11/1988 | Langer | 166/380 |
| 6,250,404 | B1 * | 6/2001 | Gunsaulis | 175/62 |
| 6,457,519 | B1 * | 10/2002 | Buytaert | 166/241.6 |
| 6,739,391 | B1 * | 5/2004 | McMahan | 166/153 |
| 2002/0157831 | A1 * | 10/2002 | Kurlenya et al. | 166/302 |

* cited by examiner

*Primary Examiner*—David Bagnell
*Assistant Examiner*—Robert Fuller

(74) *Attorney, Agent, or Firm*—Knobbe, Martens, Olson & Bear, LLP

(57) ABSTRACT

A device for keeping liquids separate in a pipe, especially for use in a petroleum well, where the device comprises a diaphragm, which in its operative position and through use of pretensioned slats is stretched across the cross section of the pipe, and where each of the two end portions of the slats is connected to a boss, respectively, in a manner such that each the slats forms an outward bow relative to the common axis of the bosses, when in the neutral position.

6 Claims, 3 Drawing Sheets

I–I

LIQUID SEPARATION DEVICE

RELATED APPLICATION

This application is the U.S. National Phase of PCT/NO02/00124 filed Mar. 25, 2002 and claims priority to Norwegian Patent Application No. 20011529 filed Mar. 26, 2001 and to Norwegian Patent Application No. 20012867 filed Jun. 11, 2001, which are hereby incorporated by reference herein.

BACKGROUND OF THE INVENTION

1. Field of the Invention

This invention regards a device, hereinafter termed a diaphragm bow, designed to segregate or separate liquids in a pipe, as is normally done during cementation work in a petroleum well, where use is often made of liquids having different density, and where mixing of the liquids would cause the cementation to be totally or partially unsuccessful.

2. Description of Related Art.

A petroleum well in which a casting operation is to be carried out will ordinarily contain drill fluid. When the grouting compound, which is slightly more viscous and has a higher density than drill fluid, is introduced at the desired location in the well, there is a considerable risk that the grouting compound may sink into the drill fluid and as a result end up in the wrong place in the well. Another danger is that it will be diluted by the drill fluid, and therefore not form a satisfactory casting.

This situation is well known to personnel working in this area, and several methods have been used to overcome the problem.

According to prior art, a relatively high viscosity liquid is during casting work in wells first pumped down to a location immediately below the location of the casting. The highly viscous liquid forms a very sluggish plug that will prevent the grouting compound subsequently pumped into the well from moving downwards and mixing with the highly viscous liquid or the drill fluid located underneath. In addition to being relatively costly, the method has proven not to work satisfactorily.

When cementing in a liner, a bridge plug may be used. However bridge plugs are not suitable for most of the cementation work that is relevant for a petroleum well.

It is also known to arrange an inflatable plug at the casting location. Inflatable plugs have a much greater field of application than bridge plugs, but have large physical dimensions and are therefore difficult to transport to the site by means of e.g. helicopter. Plugs of this type are relatively costly.

A liquid separating means is described in Norwegian patent 303649, comprising two sets of slats, where each set of slats is fixed to separate bosses connected to a common mandrel. Each set of slats distributed along the periphery of the device, and which at their free end portions are braced against e.g. a pipe wall, are provided with a cloth at these free end portions. The cloth is designed to cover the cross section of a pipe, thereby preventing liquids above and below the device from mixing. The device according to NO 303649 must be adapted to each casting operation and introduced into the well while arranged in the end portion of a lead-in pipe.

For all of the above mentioned methods, with the exception of the case of using a high viscosity liquid, the lead-in pipe must be lowered into the well just to position the liquid separating device. Often, the running in is delayed due to limitations in the pumping capacity.

SUMMARY OF THE INVENTION.

The object of the invention is to remedy the disadvantages of prior art.

The object is achieved in accordance with the characteristics stated in the description below and in the appended claims.

A diaphragm bow is formed with a number of bow slats, preferably evenly distributed about the longitudinal axis of the diaphragm bow. The bow slats are designed to be resiliently braced in against the central rodlike body of the diaphragm bow, so as to allow the device to be displaced through a pipe having a relatively small internal diameter. When the diaphragm bow reaches the site of use, thus leaving the lead-in pipe, the bow slats assume a braced position in which they abut the inside of a pipe that is to be filled with grouting compound, and which has a relatively large internal diameter. At least one circular diaphragm/cloth is connected along its periphery to the bow slats, preferably at the central part of the bow slats, thus covering the internal cross section of the relatively large pipe when the diaphragm bow is in the operative position. Experiments have shown that it is possible to achieve satisfactory sealing action at a diameter ratio of 1:10 between the lead-in pipe and the pipe to be sealed. In practice, this means that the diaphragm bow may be displaced down through a 50 mm pipe, then to expand in a manner so as to seal a 500 mm pipe against mixing of liquids.

BRIEF DESCRIPTION OF THE DRAWINGS.

The following describes a non-limiting example of a preferred embodiment illustrated in the accompanying drawings, in which.

DETAILED DESCRIPTION OF THE PREFERRED EMBODIMENT.

Figure 1:
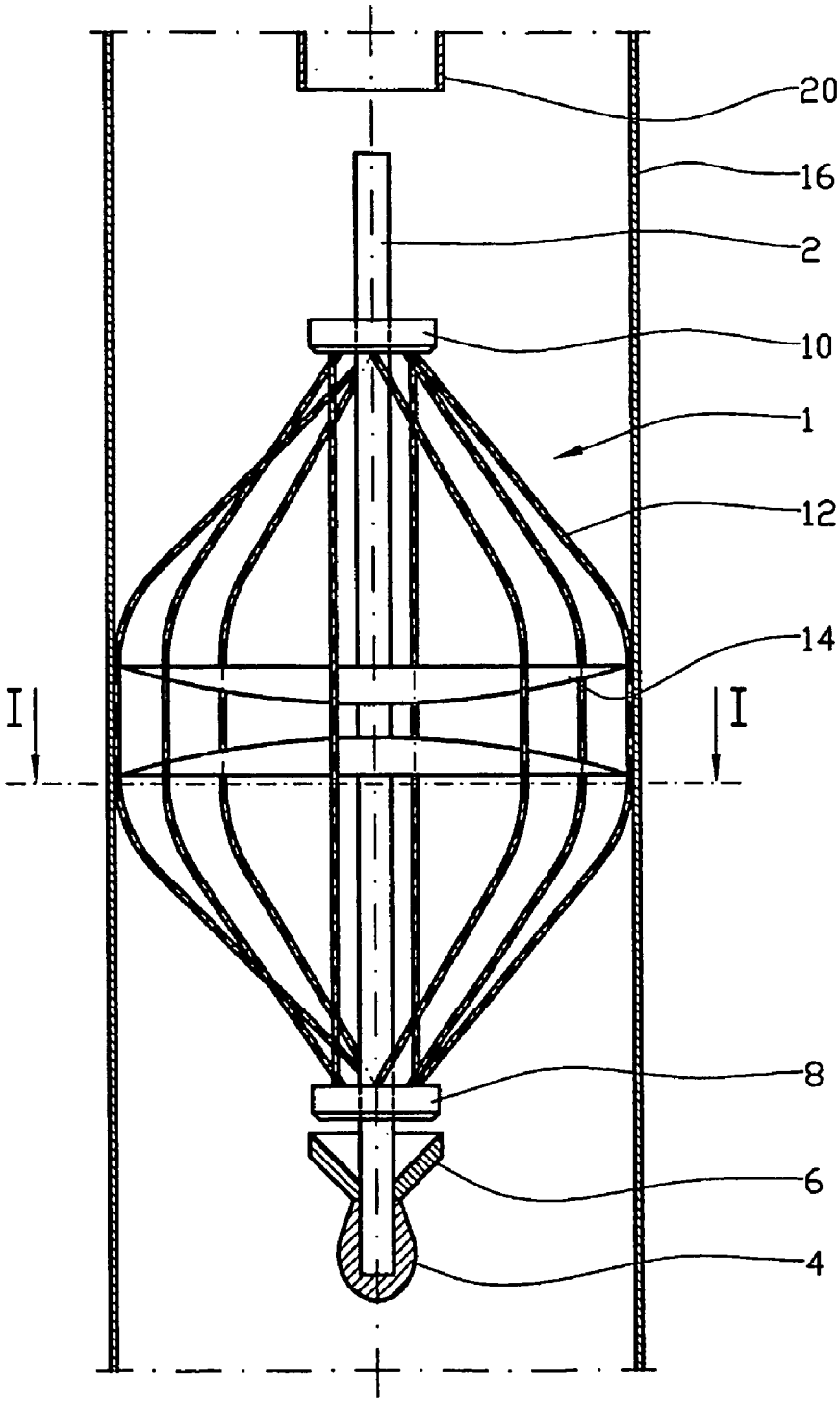
FIG. 1 shows a diaphragm bow according to the invention in the operative position in a pipe to be cemented.
Figure 2:
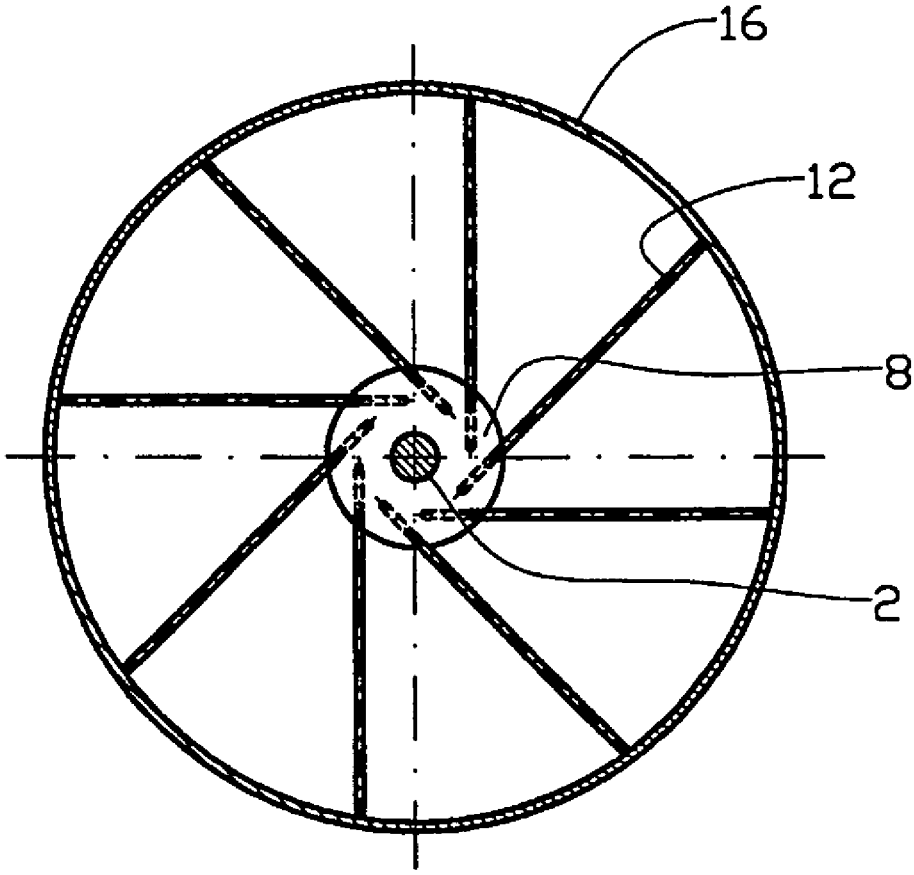
FIG. 2 shows a section I—I in FIG. 1.

In the drawings, see FIGS. 1 and 2, reference number 1 denotes a diaphragm bow comprising a central rodlike mandrel 2, the lower end portion of which is rigidly mounted to a guiding body and at least one packing 6, a boss 8 rigidly mounted to the mandrel 2, and a boss 10 that may travel along the mandrel 2.

A number of bow slats 12 are fixed between bosses 8 and 10, preferably distributed in an even manner about the longitudinal axis of the mandrel 2. The respective end portions of the bow slats 12 are rigidly mounted to the bosses 8 and 10 in a manner such as to assume an outward bow relative to the body when in the neutral position. As an example, the bow slats 12 may be glued in bores 18 in the bosses 8 and 10. The direction of the bores 18 relative to the longitudinal axis of the rod 2 and the radial direction of the bosses 8 and 10 is adjusted according to the diameters the diaphragm bow 1 is to assume in the transport state and in the operative state.

One or more circular diaphragms/cloths 14 having an external diameter slightly in excess of the internal diameter of a pipe 16 to be sealed, is connected to the central part of the bow slats 12, e.g. by means of metal wire or heat-shrinkable tubing.

Figure 3:
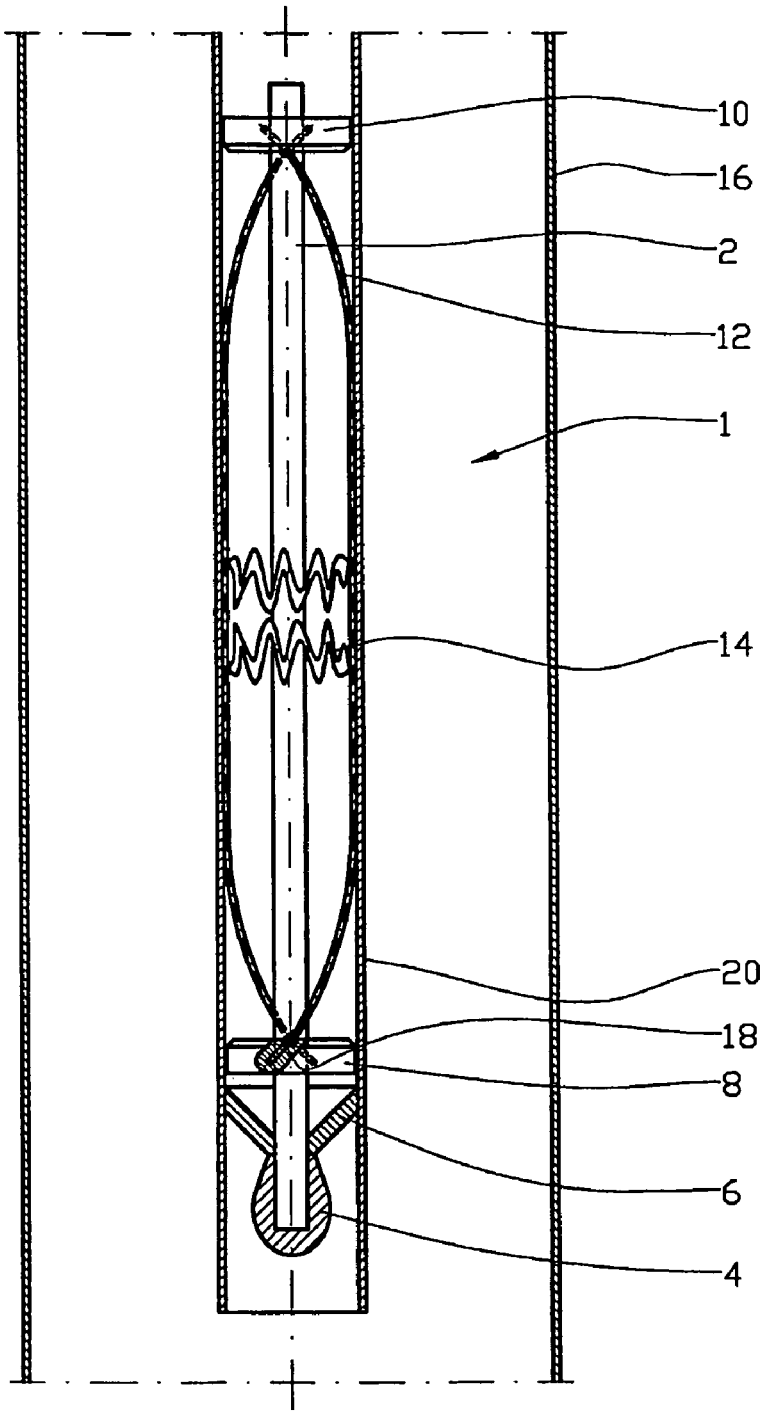
FIG. 3 shows a diaphragm bow in a state of transport, on its way down through a lead-in pipe located in the pipe to be cemented, and where the lower end portion of the lead-in pipe is located at the cementing site. The figure only shows two of the slats.

When the diaphragm bow 1 is to be displaced down through a lead-in pipe 20, see FIG. 3, the bow slats 12 are squeezed in towards the mandrel 2. When squeezed, the bow slats 12 experience resilient deformation near their mountings at the bosses 8 and 10, while the boss 10 is displaced out along the mandrel 2.

During the displacement of the diaphragm bow 1 in the lead-in pipe 20, the guiding body 4 causes the diaphragm bow 1 to steer out from e.g. pipe joints in the inside surface of the lead-in pipe 20. The packing 6 is designed to seal in a sliding manner against the inside surface of the lead-in pipe 20. Thus the diaphragm bow 1 is suitable for being pumped down through the lead-in pipe 20.

As the diaphragm bow 1 leaves the lead-in pipe 20, see FIG. 1, the resilient deformation forces in the bow slats 12 cause the travelling boss 10 to be displaced in the direction of the fixed boss 8, and the bow slats 12 assume their operative, bowed position, whereby the diaphragms 14 are stretched and seal across the internal cross section of the pipe 16.

The use of a diaphragm bow 1 according to the invention, where the diaphragm bow 1 is designed to be pumped down through a lead-in pipe 20 in order then to open up so as to close off the cross section of the pipe 16, greatly simplifies cementing operations in petroleum wells.

The invention claimed is:

1. A device for keeping liquids separate in a pipe, especially for use in a petroleum well, where the device comprises a diaphragm which in its operative position and through use of pretensioned slats is stretched across the cross section of the pipe, characterized in that each of the two end portions of the slats is connected to a boss, respectively, and where the slats are rigidly coupled to the boss such that the direction of a slat at the boss as viewed in the radial plane of the boss, exhibit a non-zero angle with an imaginary radial line from the center of the boss to the point of engagement of that particular slat at the boss.

2. A device in accordance with claim 1, characterized in that the first boss is rigidly mounted to a mandrel, to which mandrel the second boss is movably mounted.

3. A device in accordance with claim 2, characterized in that the mandrel is equipped with at least one packing.

4. A device in accordance with claim 2, characterized in that the mandrel is equipped with a guiding body.

5. A device in accordance with claim 1, characterized in that the central part of the slats is connected to at least one diaphragm.

6. A device in accordance with claim 1, characterized in that the slats are connected to the bosses by being glued into bores.

* * * * *